US008118604B2

(12) United States Patent
Ma

(10) Patent No.: US 8,118,604 B2
(45) Date of Patent: Feb. 21, 2012

(54) SOCKET CONNECTOR HAVING ELECTRICAL ELEMENT SUPPORTED BY INSULATED ELASTOMER

(75) Inventor: Hao-Yun Ma, Santa Clara (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/775,469

(22) Filed: May 6, 2010

(65) Prior Publication Data

US 2011/0275250 A1 Nov. 10, 2011

(51) Int. Cl.
*H01R 12/00* (2006.01)

(52) U.S. Cl. ..... 439/70; 439/66

(58) Field of Classification Search ..... 439/66, 439/70–73, 86, 91, 525, 526, 515, 591
See application file for complete search history.

(56) References Cited

U.S. PATENT DOCUMENTS

| | | | | |
|---|---|---|---|---|
| 5,879,168 | A * | 3/1999 | Chan et al. | 439/66 |
| 6,033,233 | A * | 3/2000 | Haseyama et al. | 439/66 |
| 6,669,490 | B1 * | 12/2003 | DelPrete et al. | 439/86 |
| 6,958,616 | B1 * | 10/2005 | Mahoney et al. | 324/755.05 |
| 7,658,616 | B2 | 2/2010 | Hougham et al. | |
| 7,833,020 | B1 * | 11/2010 | Ma et al. | 439/66 |
| 7,862,391 | B2 * | 1/2011 | Johnston et al. | 439/824 |

* cited by examiner

*Primary Examiner* — Thanh Tam Le
(74) *Attorney, Agent, or Firm* — Andrew C. Cheng; Wei Te Chung; Ming Chieh Chang

(57) ABSTRACT

A socket connector (100) adapted for electrically connecting an integrated circuit (IC) package comprises an insulative housing (1) comprising a plurality of passageways (101) extending therethrough, a plurality of terminal units (2) received in the passageways (101), the terminal units (2) each comprises an insulated elastomer (21) acting as a resilient portion and an electrical element (22) received in the insulated elastomer (21), the electrical element (22) comprises a first contact portion (221) and a second contact portion (222) extending out of the insulated elastomer (21) and sandwiching the insulated elastomer (21) therebetween.

19 Claims, 8 Drawing Sheets

SOCKET CONNECTOR HAVING ELECTRICAL ELEMENT SUPPORTED BY INSULATED ELASTOMER

BACKGROUND OF THE INVENTION

1. Field of the Invention

The present invention relates to a socket connector, and more particularly to a socket connector featured with a plurality of contact terminal units each comprises an insulated elastomer with a contact terminal supported thereon.

2. Description of the Related Art

With the development of technology, electrical socket connectors, which typically categorized into LGA and PGA in view of their mating interface with the electronic devices, have widely implemented in computers and other electrical devices for transmitting signals and conductive current between a printed circuit board (PCB) and an integrated circuit (IC) package.

A typical LGA socket connector comprises a plastic housing (such as terminal carriers) and multiple metal copper alloy terminals. As the market asks for more pin counts and smaller socket connector in dimension, a design of a new type LGA socket connector becomes more and more challenging due to a space required for terminal arms and an increasing loading force.

U.S. Pat. No. 7,658,616 submitted by IBM on Dec. 4, 2008 discloses a related land grid array (LGA) socket connector. The land grid array (LGA) socket connector comprises an insulating carrier plane and at least one interposer mounted on a first surface of said carrier plane.

The interposer selectively has a hemi-toroidal, conical, dome-shaped conic section, generally cylindrical or hemispherical configuration in transverse cross-section and is constituted of a dielectric elastomeric material. A plurality of electrically-conductive elements are arranged about the surface of said at least one hemi-toroidal interposer and extend radially inwardly and downwardly from an uppermost end thereof to electrically contact with an electrically conductive pad.

The insulating carrier plane has at least one via formed therein. The electrically-conductive pad extends through said at least one via and has portions contacting with the upper surface of said insulating carrier plane. The electrically-conductive elements each comprises a plurality of metallic strips contacting with an upper surface of said pad. The interposers of essentially conical or dome-shaped conic sections are arranged in pairs and in groups with a predetermined number of said interposers. In each said group, the electrically-conductive elements of each said interposers joint with proximate said at least one via in said insulating carrier plane and contact with said pad to form a common connection at a lower surface of said insulating carrier plane, and each of the interposers in one group differs in height from another one in another group.

One of the problems is that when the electrically-conductive elements become smaller and smaller, the electrically-conductive element tends to crash or deform beyond its yielding point easily such that a permanent deformation will be encountered. Once the electrically-conductive elements are crashed, it is unlikely to provide sufficient normal force which is absolutely required for a reliable and robust interconnection. Accordingly, once the electrically-conductive element becomes smaller and smaller, an auxiliary support is therefore required.

Hence, an improved socket connector is required to overcome the disadvantages of the prior art.

SUMMARY OF THE INVENTION

An object of the invention is to provide a socket connector having terminal units with simple configuration and good elasticity to prevent being crashed.

To achieve the above-mentioned object, a socket connector adapted for electrically connecting an integrated circuit (IC) package comprises a base comprising a plurality of passageways extending vertically therethrough, a plurality of terminal units received in the passageways, the terminal units each comprises an insulated elastomer acting as a resilient portion and an electrical element supported thereon, the electrical element comprises a first contact portion and a second contact portion extending out of the insulated elastomer and sandwiching the insulated elastomer therebetween.

Other features and advantages of the present invention will become more apparent to those skilled in the art upon examination of the following drawings and detailed description of preferred embodiments, in which:

DETAILED DESCRIPTION OF PREFERRED EMBODIMENT

Reference will now be made in detail to the preferred embodiment of the present invention.

Figure 1:
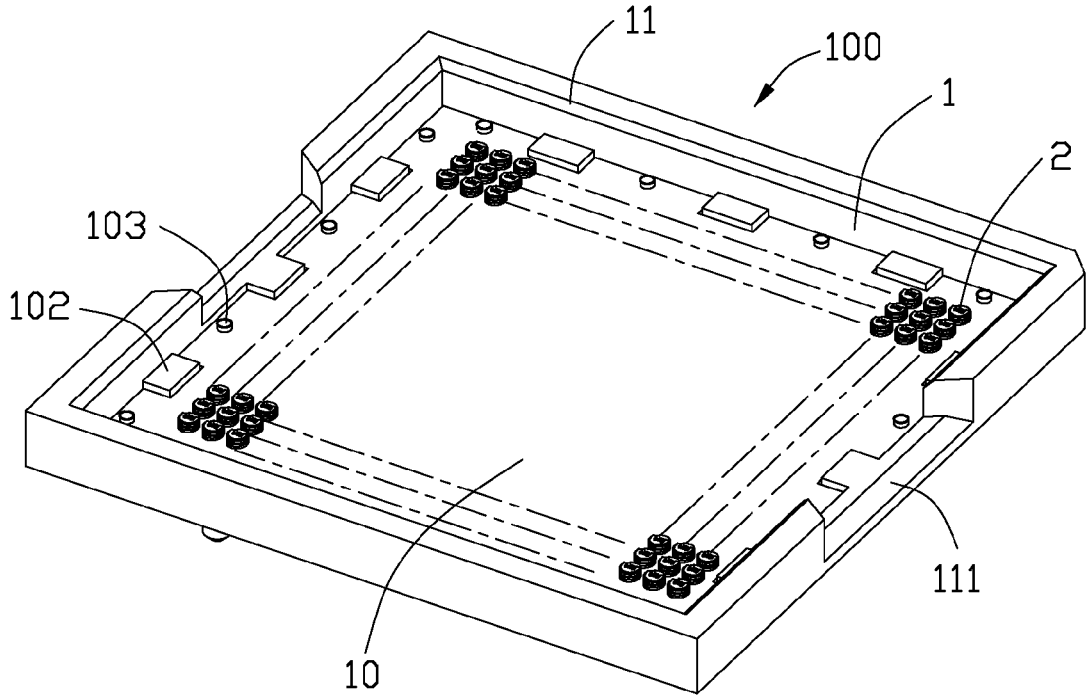
FIG. 1 is an assembled, perspective view of a socket connector in accordance with a preferred embodiment of the present invention.
Figure 2:
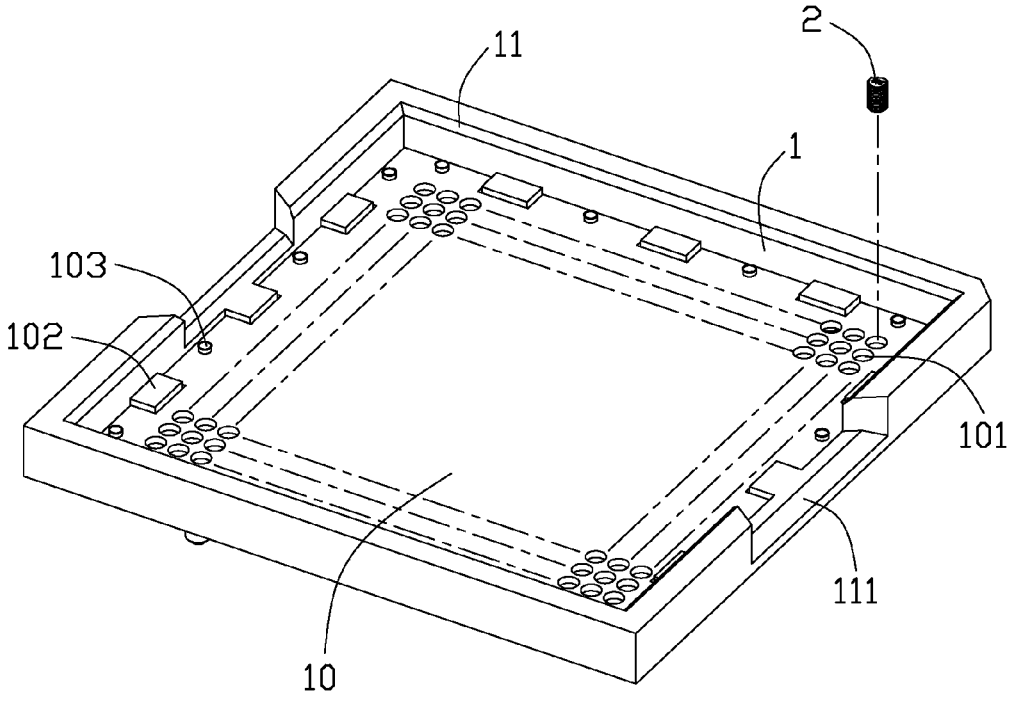
FIG. 2 is an exploded, perspective view of the socket connector shown in FIG. 1.

Referring to FIGS. 1-2, a socket connector 100 in accordance with a preferred embodiment of the present invention is adapted for electrically connecting an integrated circuit (IC) package (not shown) to a printed circuit board (not shown). The socket connector 100 comprises an insulative housing 1 and a plurality of terminal units 2 assembled on the insulative housing 1.

Referring to FIG. 2, the insulative housing 1 includes a rectangular base 10 and four peripheral walls 11 surrounding the base 10. The peripheral walls 11 extend over the base 10. The base 10 together with the peripheral walls 11 define a space for receiving the IC package (not shown). The base 10 defines a plurality of passageways 101 extending therethrough and arranged in a rectangular array for receiving a corresponding number of terminal units 2 therein.

A number of supporting portions 102 extend upwardly from a top surface of the base 10 and are adjacent to the peripheral walls 11. There are also a number of projections 103 extending from the top surface of the base 10 and are located between two adjacent supporting portions 102. The supporting portions 102 and the projections 103 jointly support the IC package (not shown) so as to avoid damaging of the terminal units 2. A pair of notches 111 is defined at a middle of the two opposite periphery walls 11 respectively for conveniently taking the IC package (not shown) out.

Figure 3:
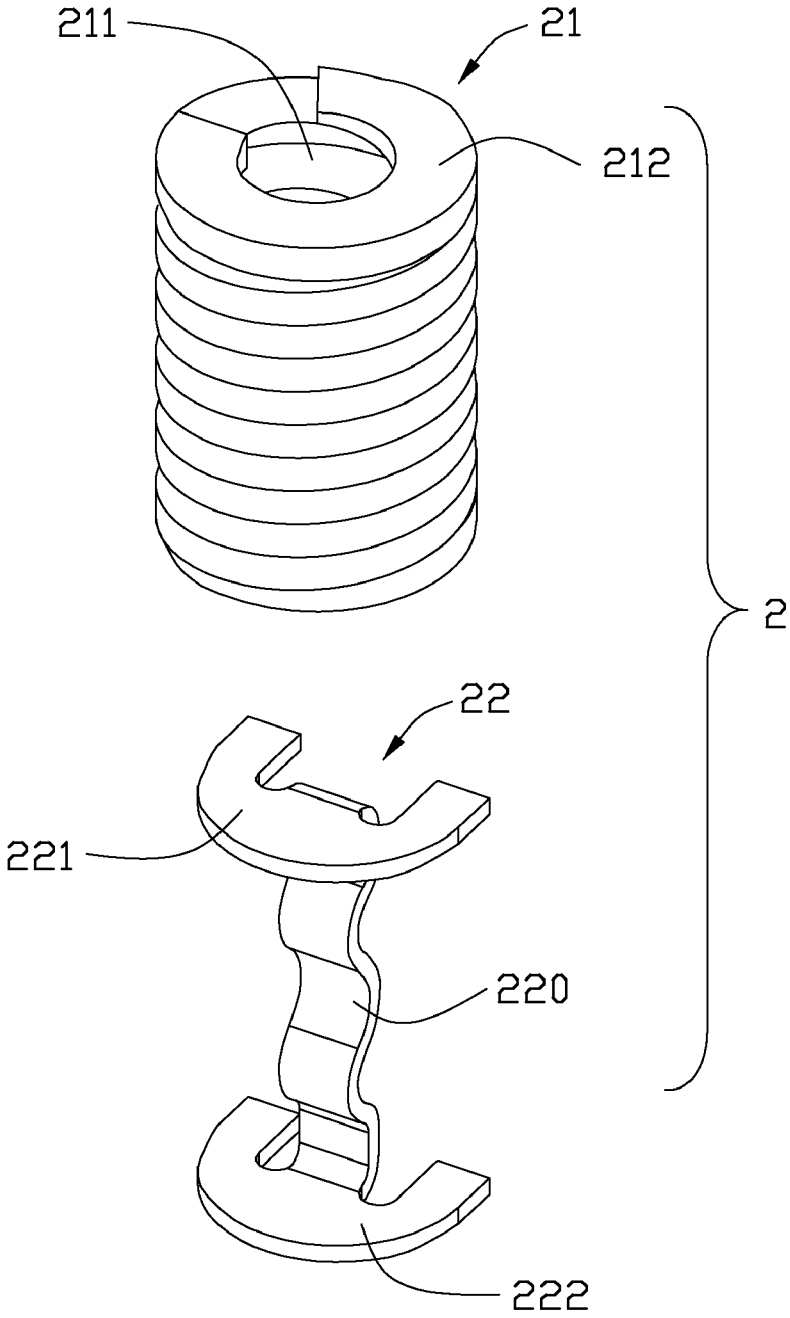
FIG. 3 is an exploded, perspective view of a terminal unit of the socket connector shown in FIG. 2.
Figure 4:
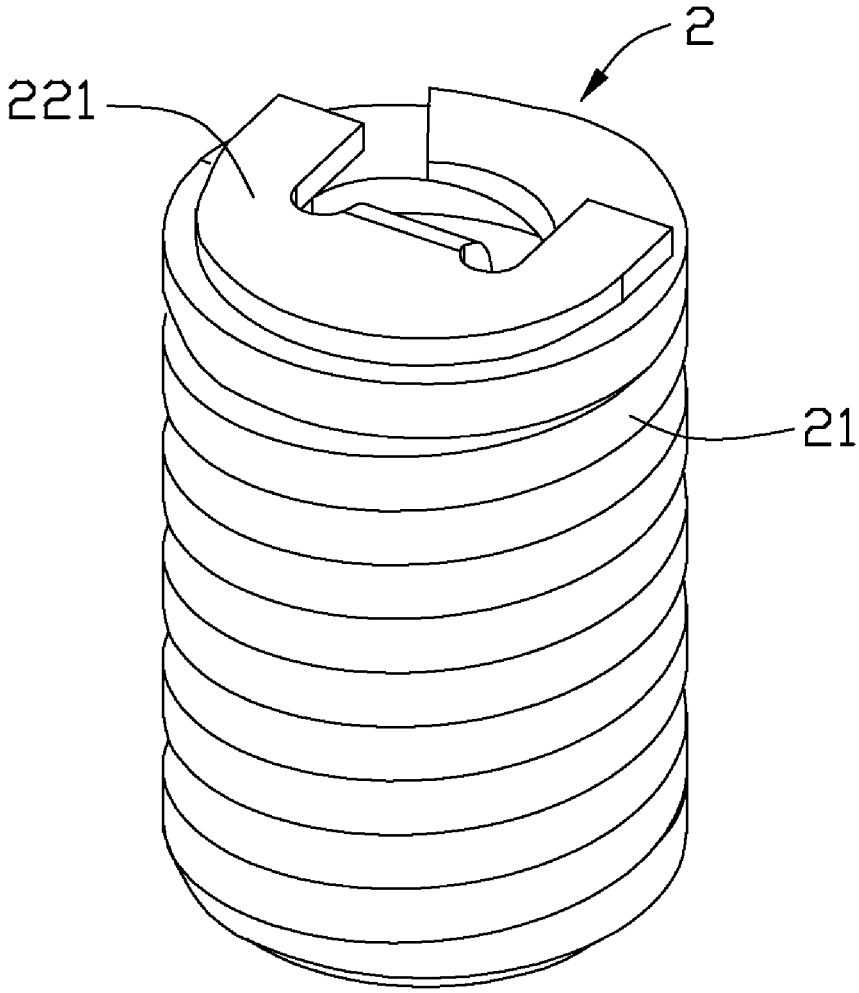
FIG. 4 is an assembled, perspective view of the terminal unit shown in FIG. 3.
Figure 5:
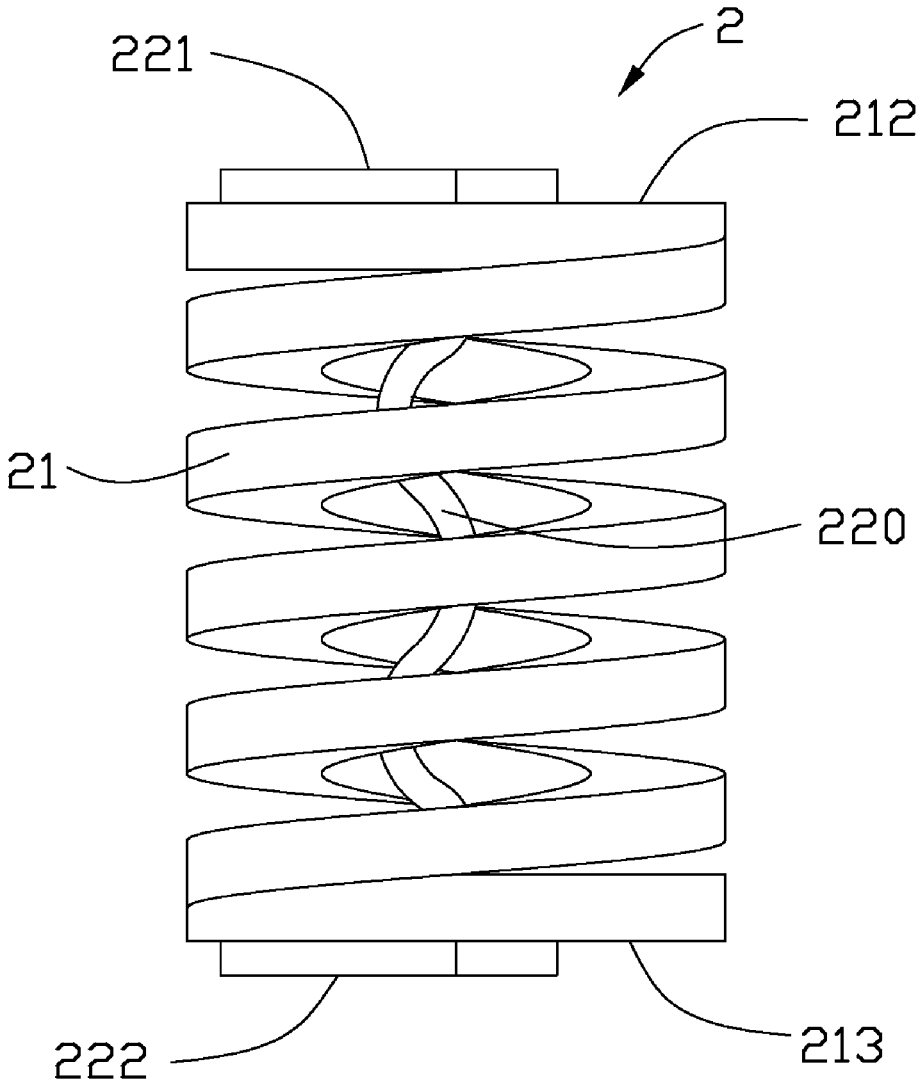
FIG. 5 is a side view of the terminal unit shown in FIG. 4.
Figure 6:
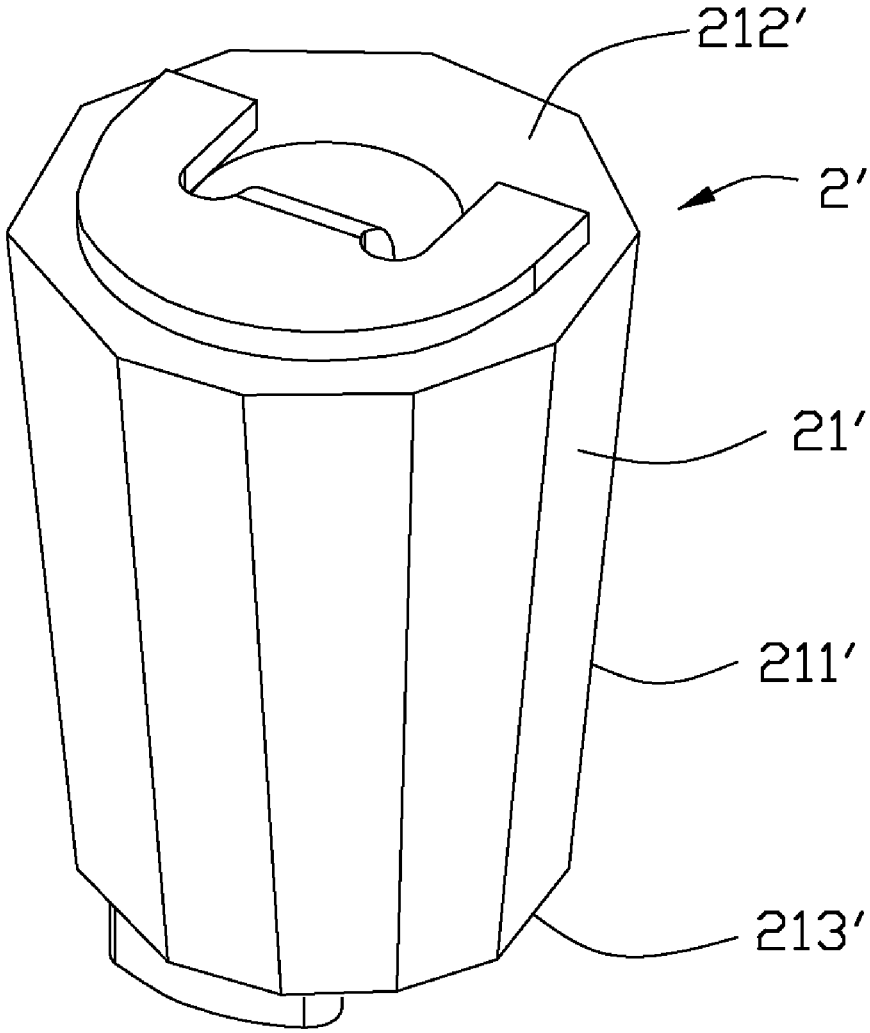
FIG. 6 is a second embodiment of the terminal unit shown in FIG. 4.
Figure 7:
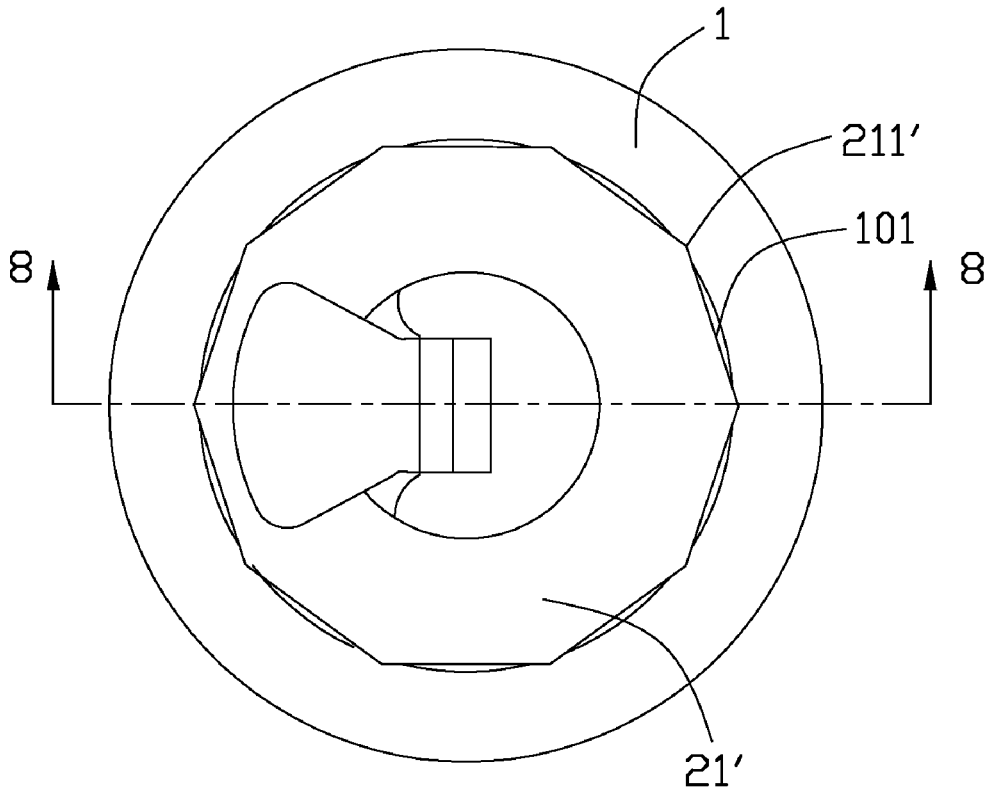
FIG. 7 shown a terminal unit in FIG. 6 is assembled to the insulative housing.
Figure 8:
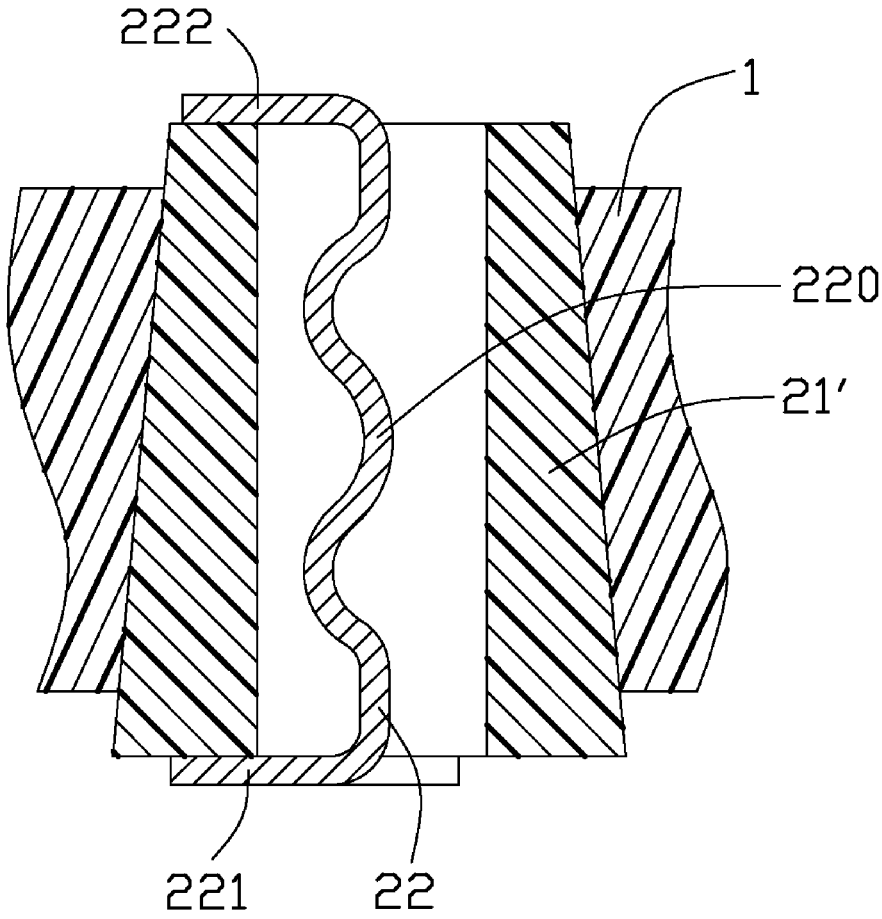
FIG. 8 is a cross-sectional view along line 8-8 of FIG. 7.

Referring to FIGS. 3-4, the terminal units 2 each comprises an insulated elastomer 21 and an electrical element 22 supported thereon. The insulated elastomer 21 is configured to a helical configuration or other adequate configuration to provide additional support thereof for compacting along with the electrical element 22 and extension to strengthen the electrical element 22 and can provide the terminal units 2 with additional elasticity. The insulated elastomer 21 has an upper surface 212 and a lower surface 213 opposite to each other. The insulated elastomer 21 defines a through hole 211 extending therethrough. Referring to FIG. 6, shown a second embodiment of the terminal units 2 of FIG. 4, the difference is the upper surface 212' and the lower surface 213' of the insulated elastomer 21' are configured to polygonal shape due to the plurality of ribs 211' on the surface of the column-shaped insulated elastomer 21' along a up to down direction. Referring to FIG. 7-8, when the terminal unit 2' is assembled to the passageway 101 of the insulative housing 1, the ribs 211' interference with the insulative housing 1 to make the terminal unit 2' positioned in the passageway 101 securely.

The electrical element 22 is made of metal sheet and comprises a spring body portion 220 with an S-shaped configuration, a first contact portion 221 extending from the upper end thereof for connecting with the IC package, and a second contact portion 222 extending from the lower end thereof for connecting with the printed circuit board. The first contact portion 221 and the second contact portion 222 are configured to a U-shaped configuration or other adequate configuration to hook with the upper surface 212 and the lower surface 213 respectively. When the electrical element 22 are assembled to the insulated elastomer 21, the S-shaped body portion 220 is received in the through hole 211 of the insulated elastomer 21, the second contact portion 222 engages with the lower surface 213 of the insulated elastomer 21 and the first contact portion 221 is bending from the body portion 220 to hook with the upper surface 212. Thus, the electrical element 22 is securely located on the insulated elastomer 21.

In use, when an IC package is assembled to the insulative housing 1, the IC package exerts a downward force on the upper contact portion 221 of the electrical element 22. The S-shaped body portion 220 is deformed and the upper contact portion 221 presses the insulated elastomer 21, 21' to be deformed. Thus, a good electrical connection is established between the IC package and the electrical elements 22 of the terminal units 2, 2'. When the IC package is removed, the spring of the insulated elastomer 21, 21' makes the terminal units 2, 2' come back to its original state.

While the present invention has been described with reference to preferred embodiments, the description of the invention is illustrative and is not to be construed as limiting the invention. Various of modifications to the present invention can be made to preferred embodiments by those skilled in the art without departing from the true spirit and scope of the invention as defined by the appended claims.

What is claimed is:

1. A socket connector adapted for electrically connecting an integrated circuit (IC) package, comprising:

an insulative housing comprising a plurality of passageways extending therethrough; and a plurality of terminal units received in the passageways and each terminal unit comprising an insulated elastomer with helical shape acting as a resilient portion and an electrical element received in the insulated elastomer, the electrical element comprising a first contact portion and a second contact portion extending out of the insulated elastomer and sandwiching the insulated elastomer therebetween.

2. The socket connector as described in claim 1, wherein the insulated elastomer is configured to column shape with a plurality of ribs from an up to down direction.

3. The socket connector as described in claim 2, wherein the ribs interference with the insulative housing.

4. The socket connector as described in claim 1, wherein the insulated elastomer comprises an upper surface, a lower surface opposite to the upper surface and a through hole impenetrate therethrough.

5. The socket connector as described in claim 4, wherein the first contact portion is bending to engage with the upper surface and the second contact portion engages with the lower surface of the insulated elastomer respectively.

6. The socket connector as described in claim 5, wherein the electrical element also comprises a body portion located between the first contact portion and the second contact portion and received in the through hole of the insulated elastomer.

7. The socket connector as described in claim 1, wherein the insulative housing comprises a base, periphery walls extending upwardly from the base and a receiving space formed by the base and the periphery walls.

8. The socket connector as described in claim 7, wherein a plurality of supporting portions extend upwardly from the base and are located adjacent to the periphery walls.

9. The socket connector as described in claim 8, wherein a plurality of projections extend from the base and are located between two adjacent supporting portions.

10. A socket connector for use with an IC package, comprising:

an insulative housing with a plurality of passageways extending therethrough; and a plurality of terminal units disposed in the corresponding passageways, respectively, each of said terminal units including an insulated elastomer piece associated with an electrical element made of metal sheet; wherein said electrical element said insulated elastomer piece being deformable in a vertical direction, and two opposite ends of the electrical element being supported by two opposite surfaces of the insulated elastomer in the vertical direction, respectively.

11. The socket connector as described in claim 10, wherein the insulated elastomer is configured to helical shape.

12. The socket connector as described in claim 10, wherein the insulated elastomer is configured to column shape with a plurality of ribs from an up to down direction.

13. The socket connector as described in claim 12, wherein the ribs interference with the insulative housing.

14. The socket connector as described in claim 10, wherein the insulated elastomer comprises an upper surface, a lower surface opposite to the upper surface, the electrical element comprises a first contact portion and a second contact portion engaged with the upper surface and the lower surface respectively.

15. The socket connector as described in claim 14, wherein the electrical element also comprises a body portion with an S-shape between the first contact portion and the second contact portion.

16. An electrical connector comprising:

an insulative housing defining two opposite surfaces with a plurality of through holes therebetween in a vertical direction;

a plurality of terminals disposed in the corresponding through holes, respectively, each of said terminals including a metallic electrical element supported by an insulative elastomer which is materially different from the insulative housing and whose two opposite ends extend respectively beyond said two opposite surfaces of the housing in the vertical direction, under condition that both said electrical element and said elastomer are compressible in said vertical direction; wherein the electrical element is dimensioned less than the elastomer while having two opposite ends exposed on two opposite exterior faces of the elastomer so that forces imposed upon the two opposite ends of the electrical element will be transferred to the elastomer.

17. The electrical connector as claimed in claim 16, wherein said electrical element is essentially constantly associated with the elastomer via the two opposite ends cooperatively sandwiching the elastomer therebetween.

18. The electrical connector as claimed in claim 16, wherein said elastomer surrounds said electrical element except said two opposite ends.

19. The electrical connector as claimed in claim 16, wherein said elastomer interferes with the corresponding through hole.

* * * * *